US008485757B2

(12) United States Patent
Nomoto

(10) Patent No.: US 8,485,757 B2
(45) Date of Patent: Jul. 16, 2013

(54) SHAPE-RETENTION-TYPE HOISTING RECTANGULAR PARALLELEPIPED BAG

(76) Inventor: Futoshi Nomoto, Saitama (JP)

( * ) Notice: Subject to any disclaimer, the term of this patent is extended or adjusted under 35 U.S.C. 154(b) by 335 days.

(21) Appl. No.: 12/674,473

(22) PCT Filed: Mar. 17, 2008

(86) PCT No.: PCT/JP2008/054897

§ 371 (c)(1),
(2), (4) Date: Feb. 22, 2010

(87) PCT Pub. No.: WO2009/025098

PCT Pub. Date: Feb. 26, 2009

(65) Prior Publication Data

US 2011/0262056 A1 Oct. 27, 2011

(30) Foreign Application Priority Data

Aug. 21, 2007 (JP) ..... 2007-214962

(51) Int. Cl.
*E02B 3/04* (2006.01)

(52) U.S. Cl.
USPC ..... 405/107; 405/114; 383/16; 383/17; 383/18

(58) Field of Classification Search
USPC ..... 405/107, 111, 114, 116; 383/12, 383/15, 16, 17, 18, 19
See application file for complete search history.

(56) References Cited

U.S. PATENT DOCUMENTS

| | | | | | |
|---|---|---|---|---|---|
| 4,390,051 | A * | 6/1983 | Cuthbertson | 383/111 |
| 4,395,067 | A * | 7/1983 | Robin | 294/74 |
| 5,073,035 | A * | 12/1991 | Williams | 383/19 |
| 5,104,236 | A * | 4/1992 | LaFleur | 383/17 |
| 6,155,772 | A * | 12/2000 | Beale | 414/607 |
| 2011/0262056 | A1 * | 10/2011 | Nomoto | 383/17 |

FOREIGN PATENT DOCUMENTS

| | | | |
|---|---|---|---|
| JP | 05124652 | A * | 5/1993 |
| JP | 07125791 | A * | 5/1995 |
| JP | 11334786 | A * | 12/1999 |
| JP | 2005076439 | A | 3/2005 |
| KR | 200410540 | A | 3/2006 |

* cited by examiner

*Primary Examiner* — John Kreck
*Assistant Examiner* — Benjamin Fiorello
(74) *Attorney, Agent, or Firm* — Porzio, Bromberg & Newman, P.C.

(57) ABSTRACT

A shape-retention hoisting including a rectangular parallelepiped bag. Base bands are provided along diagonal lines of the rectangular parallelepiped bag. A quadrangular-prism-shaped lift band is secured to a point of intersection of the base bands. One end of a truss band is secured by a fixing band surrounding the quadrangular-prism-shaped lift band, and the other end thereof is secured to the base band at a point spaced apart by a given distance from the center of the lift band. In this way, a plurality of truss bands can be disposed on the lift band in the vertical direction, thereby resolving a weight applied to a single truss band and maintaining the shape of the shape-retention hoisting bag.

5 Claims, 14 Drawing Sheets

(A)

(B)

(A)

(B)

(A)

(B)

(A)

(B)

(A)

(B)

(A)

(B)

(A)

(B)

(A)

(B)

SHAPE-RETENTION-TYPE HOISTING RECTANGULAR PARALLELEPIPED BAG

CROSS REFERENCE TO RELATED APPLICATION

This is a National Stage of International Application No. PCT/JP2008/054897, filed 17 Mar. 2008, which claims the benefit of Application No. 2007-214962, filed in Japan on 21 Aug. 2007, the disclosures of which Applications are incorporated by reference herein.

BACKGROUND OF THE INVENTION

1. Field of the Invention

The present invention relates mainly to very large sand bags which are used, for example, for irrigation works or river-improvement works, slope face reinforcement or retaining wall constructions, accretion for roads or buildings, reclamation works, and natural disaster restoration works. In particular, the invention relates to a shape-retention-type hoisting rectangular parallelepiped bag which requires only one hanging mechanism for execution of works while maintaining a stable, easy-to-pile shape when a plurality of rectangular parallelepiped sand bags are stacked one on another for use. The invention further relates to a bag which can be employed in combination with a sandbag involved construction method that employs small sand bags, and which allows execution of works to cover a large area at one time, thereby providing improved work efficiency. Furthermore, another aspect of the inventive bag or its rectangular shape can also be utilized to carry grain-shaped substances such as wheat or soybeans in the bag, allowing for loading goods or placing stocks with improved efficiency. This improvement can be seen when compared to conventional sand bags which typically have a cylindrical shape or an inverted balloon (or a cloth bag tightly closed at its open end), thus causing gaps between the sand bags.

2. Description of Related Art

Sand bags are piled up or stacked in layers for use in irrigation works or river-improvement works and restoration works from natural disasters caused by, for example, typhoon or heavy rain. Conventional sand bags are prepared, as shown in FIG. 13, in a manner such that a sand bag 101 of high durability, such as hempen bags or polyethylene or polypropylene bags or meshed bags, is filled with soil, and the opening of the bag is closed with Velcro closure (registered trade mark) 105 or the like. Typical larger sand bags for construction works may weigh one ton or greater, so that those sand bags are carried using crane trucks or backhoes. As shown in FIG. 14, a plurality of sand bags 101 are often stacked in layers for restoration works from natural disaster caused by typhoon or heavy rain.

SUMMARY OF THE INVENTION

FIG. 11 relates to a rectangular parallelepiped bag 11 of a patent of the inventor (Patent Document 1). The bag 11 has one end of a lift band 30 secured to a central portion 19 on a bottom surface 12. The bottom surface of the rectangular parallelepiped bag 11 has four vertices 18*a* to 18*d*, and along each of the diagonal lines, has one end of each of four, i.e., first to fourth truss bands 21*a* to 21*d* secured at each of points 18*a*1, 18*b*1, 18*c*1, and 18*d*1 which is spaced apart by a given distance from each vertex. The rectangular parallelepiped bag 11 is supported at five points of the central portion 19 and the four vertices 18*a* to 18*d* on the bottom surface 12, with the other end of the truss bands 21*a* to 21*d* secured to a fixing point 30*a* on the lift band 30. Lifting the rectangular parallelepiped bag using the lift band 30 would cause the sand inside the rectangular parallelepiped bag is compressed and takes the rectangular parallelepiped shape, thereby stabilizing the shape of the rectangular parallelepiped bag. Accordingly, this allows a plurality of shape-retention-type hoisting rectangular parallelepiped bags to be neatly stacked in layers, and significant reduction in time required for works.

FIG. 12 is an explanatory view illustrating the principle of a conventional shape-retention-type hoisting rectangular parallelepiped bag. In FIG. 12, the points 18*a* and 18*b* are pulled with the lift bands 21*a* and 21*b* that are connected between the respective points 18*a* and 18*b* and the point 30*a*. This generates upward force and lateral force, causing the soil in the hatched portion to be compressed and packed down. The shape of the rectangular parallelepiped bag 1 can thus be maintained with stability.

Patent Document 1: Japanese Patent Publication No. 3949156

However, the conventional rectangular parallelepiped bag disclosed in Patent Document 1 can measure approximately 1 meter per side at maximum for practical use, but may become unstable in shape with each side being above 1 meter, thus making it difficult to pile up a plurality of bags for use. That is, when those bags are carried or piled up using a crane truck or the like, the soil inside the bag will be dislocated thereby causing the shape of the bag to be deformed. That is, this drawback of the sand bag can be described as follows. As the bag increases in size, the distance in the vertical direction of the bag increases. This requires a longer distance for the hanging band attached vertically at the center of the bag to push up the inner material and generate sufficient friction between the material and the truss bands provided along the diagonal lines. This resulted in a drawback that the whole bag was deformed into a shape like "^." In other words, as the width of the sand bag increases, an increased number of truss bands are required to maintain the rectangular parallelepiped shape of the sand bag as it is.

The present invention was developed in view of the aforementioned problems. It is therefore an object of the invention to provide a sand bag which can be easily piled up while maintaining its rectangular parallelepiped shape even if it is a very large flat rectangular parallelepiped bag with its side being greater than 1 meter.

To solve the aforementioned problems, the present invention is characterized by including: a rectangular parallelepiped bag formed in a rectangular parallelepiped shape and filled in with soil; base bands provided along diagonal lines of the rectangular parallelepiped bag; a quadrangular-prism-shaped lift band having one end connected to a point of intersection of the base bands and the other end connected to a hanging portion; a plurality of fixing bands surrounding the quadrangular-prism-shaped lift band; and a plurality of truss bands, each of the truss bands having one end secured to each of the fixing bands on each surface of the quadrangular prism shape between the lift band and the fixing band, each of the truss bands having the other end secured to the base band at a point spaced apart by a given distance from the center of the lift band.

The present invention is characterized in that the point spaced apart by the given distance from the center is set so that one end of a lift band having the other end secured to an upper fixing band of the plurality of fixing bands is located at a distance farther from the center than one end of a lift band having the other end secured to a lower fixing band.

The present invention is also characterized by including: a rectangular parallelepiped bag formed in a rectangular parallelepiped shape and filled in with soil; base bands provided along diagonal lines of the rectangular parallelepiped bag; a quadrangular-prism-shaped lift band having one end connected to a point of intersection of the base bands and the other end connected to a hanging portion; a plurality of upper hoisting rings fixed at different heights on each surface of the quadrangular-prism-shaped lift band; a plurality of lower hoisting rings located on the base band at predetermined different distances from the center of the lift band; and a plurality of truss bands, each of the truss bands having one end secured to each of the upper hoisting rings on each surface of the lift band, each of the truss bands having the other end secured to each of the lower hoisting rings.

The present invention is also characterized by including: a rectangular parallelepiped bag formed in a rectangular parallelepiped shape and filled in with soil; base bands provided along diagonal lines of the rectangular parallelepiped bag; a plurality of lower hoisting ring securing portions located opposite to points on the base band at predetermined different distances from the center of the aforementioned rectangular parallelepiped bag; and a plurality of truss bands, each of the truss bands having one end secured to a lower hoisting ring provided at one side of the opposing lower hoisting ring securing portion, each of the truss bands having the other end secured to a lower hoisting ring provided at the other side, the truss band being secured at a lift band securing portion provided in position, the truss band being folded over at a midpoint thereof to form a hanging portion.

The end of the hanging portion is preferably formed in an arch shape to be hooked.

The bag according to the present invention configured to include: a rectangular parallelepiped bag formed in a rectangular parallelepiped shape and filled in with soil; base bands provided along diagonal lines of the rectangular parallelepiped bag; a quadrangular-prism-shaped lift band having one end connected to a point of intersection of the base bands and the other end connected to a hanging portion; a plurality of quadrangular-prism-frame-type fixing bands surrounding the quadrangular-prism-shaped lift band; and a plurality of truss bands, each of the truss bands having one end secured to each of the fixing bands on each surface of the lift band between the lift band and the fixing band, each of the truss bands having the other end secured to the base band at a point spaced apart by a given distance from the center of the lift band. As such, use of the plurality of truss bands makes it possible to extend the range of compressing the soil around the truss bands within the rectangular parallelepiped bag gradually in stages from the center. This allows for providing a large shape-retention-type hoisting rectangular parallelepiped bag.

The bag according to the present invention is configured such that the point spaced apart by a given distance from the center is set so that one end of a lift band having the other end secured to an upper fixing band of the plurality of fixing bands is located at a distance farther from the center than one end of a lift band having the other end secured to a lower fixing band. This configuration allows for providing a plurality of truss bands in the direction of height to extend the range of compressing the soil by the friction generated between soil grains, thereby making the bag applicable to a large shape-retention-type hoisting rectangular parallelepiped bag.

Furthermore, the bag according to the present invention is configured to include: a rectangular parallelepiped bag formed in a rectangular parallelepiped shape and filled in with soil; base bands provided along diagonal lines of the rectangular parallelepiped bag; a quadrangular-prism-shaped lift band having one end connected to a point of intersection of the base bands and the other end connected to a hanging portion; a plurality of upper hoisting ring securing portions fixed at different heights on each surface of the quadrangular-prism-shaped lift band; a plurality of lower hoisting ring securing portions located on the base band at predetermined different distances from the center of the lift band; and a plurality of truss bands, each of the truss bands having one end secured via a hook to each of the upper hoisting ring securing portions on each surface of the lift band, each of the truss bands having the other end secured via a hook to each of the lower hoisting ring securing portions. This configuration allows the truss bands to be readily attached to the bag.

Furthermore, the bag according to the present invention is configured to include: a rectangular parallelepiped bag formed in a rectangular parallelepiped shape and filled in with soil; base bands provided along diagonal lines of the rectangular parallelepiped bag; a plurality of lower hoisting ring securing portions located opposite to points on the base band at predetermined different distances from the center of the aforementioned rectangular parallelepiped bag; and a plurality of truss bands, each of the truss bands having one end secured to a lower hoisting ring provided at one side of the opposing lower hoisting ring securing portion, each of the truss bands having the other end secured to a lower hoisting ring provided at the other side, the truss band being secured at a lift band securing portion provided in position, the truss band being folded over at a midpoint thereof to form a hanging portion. This configuration allows the truss bands to be more readily attached to the bag.

Furthermore, according to the present invention, the end of the lift band is formed in an arch shape to be hooked. This makes it possible to use crane trucks or the like to easily hoist the shape-retention-type hoisting rectangular parallelepiped bag.

DETAILED DESCRIPTION

The present invention will now be described below with reference to the drawings in accordance with the embodiments. FIG. 1 is a perspective view illustrating a shape-retention-type hoisting rectangular parallelepiped bag 1 according to an embodiment of the present invention. FIG. 2 is a plan view illustrating the shape-retention-type hoisting rectangular parallelepiped bag 1.

In FIGS. 1 and 2, reference numeral 1 denotes a shape-retention-type hoisting rectangular parallelepiped bag, and 11 shows a rectangular parallelepiped bag which forms the shape-retention-type hoisting rectangular parallelepiped bag 1. The rectangular parallelepiped bag 11 may be made of a durable, flexible material, for example, natural material such as hemp, chemical fibers such as polyethylene or polypropylene, or any other material that can form a bag-like shape. The rectangular parallelepiped bag 11 is formed in a rectangular parallelepiped shape, and provided on top thereof with right and left cover portions 13*a* and 13*b*, forward and backward cover portions 14*a* and 14*b*, and belts 15 and lock members 16 for closing the forward and backward cover portions 14*a* and 14*b*. Furthermore, the belts 15 can also be increased in number according to the weight and type of the material filled inside. Note that the number of the belts 15 has to be about four when the shape-retention-type hoisting rectangular parallelepiped bag weighs about 1 ton. On the other hand, although not illustrated, the belts 15 and the lock members 16 for closing the right and left cover portions 13*a* and 13*b* can also be provided on the right and left cover portions 13*a* and 13*b*. Furthermore, the cover portions 13*a* and 13*b*, and 14*a* and 14*b* can also be integrated with the rectangular parallelepiped bag 11.

Reference numeral 30 denotes a lift band, and 21*a* to 21*d* and 22*a* to 22*d* show truss bands. The lift band 30 and the truss bands 21*a* to 21*d* and 22*a* to 22*d* are used to hang the rectangular parallelepiped bag 11. The lift band 30 is formed in the shape of a quadrangular prism, while the truss bands 21*a* to 21*d* and 22*a* to 22*d* are formed in the shape of a string or belt, each being made of a durable material. Reference numeral 17 denotes a groove for providing an opening to draw out the lift band 30 when the forward and backward cover portions 14*a* and 14*b* are closed.

The truss band 21 has one end secured to a point of intersection of two base bands 24 provided along diagonal lines on the bottom surface 12 of the rectangular parallelepiped bag 11. As will be detailed later, the truss bands 21*a* to 21*d* and 22*a* to 22*d* each have one end secured between the lift band 30 and a fixing band 31. The other end of each of the truss bands is secured to the base band at a point spaced by a given distance apart from the center of the lift band 30.

FIG. 3 shows how to provide two-stage truss bands according to an embodiment of the present invention. FIG. 3(A) shows lift fixing bands organized in two stages. As described above, the truss bands 21*a* and 21*c* have one end secured between the lift band 30 and the lift fixing band 31, while the truss bands 22*a* and 22*c* have one end secured between the lift band 30 and a lift fixing band 32. On the other hand, the other ends of the truss bands 21*a* and 21*c* are secured at respective points on the base band 24, while the other end of the truss bands 22*a* and 22*c* is secured at the other point on the base band 24. As schematically shown in FIG. 3, both ends of the truss bands 21 and 22 are folded and connected to the lift band 30, the lift fixing band 31 and the base bands 24. These connections will be described later in more detail with reference to FIG. 4.

FIG. 3(B) shows the lift fixing band 31 organized in three stages. As can be seen from the figure, a plurality of lift fixing bands can be provided. That is, as the rectangular parallelepiped bag increases in shape, the number of lift fixing band stages can be increased to accommodate an increased number of truss bands to be secured thereto. This configuration makes it possible to keep the shape of the rectangular parallelepiped bag 1 unchanged. Furthermore, a plurality of truss bands are provided on the vertical lift band, thereby distributing the load imposed on one truss band and thus ensuring the safety of the bag.

In FIG. 3(B), as with the discussion above, the truss bands 21*a* and 21*c* have one end secured between the lift band 30 and the lift fixing band 31, while the truss bands 22*a* and 22*c* have one end secured between the lift band 30 and the lift fixing band 32. The truss bands 23*a* and 23*c* have one end secured between the lift band 30 and a lift fixing band 33. On the other hand, the truss bands 21*a* and 21*c* have the respective other ends secured at respective points 18*a*1 and 18*c*1 on the base band 24. The truss bands 22*a* and 22*c* have the respective other end secured at respective points 19*a*1 and 19*c*1 on the base band 24, while the truss bands 23*a* and 23*c* have the respective other ends secured at respective points 19*a*1 and 19*c*1 on the base band 24. As schematically shown in FIG. 3(B), both ends of the truss bands 21 and 22 are also folded and simply connected to the lift band 30, the lift fixing bands 31, 32, and 33, and the base bands 24. These connections will be described later in more detail with reference to FIG. 4.

The lift band 30 is connected at its top with a hanging portion 29. The end of the hanging portion 29 is formed in the shape of an arch to be hooked with a heavy machine such as a crane truck or backhoe. The hanging portion 29 may be formed in the shape of a hook or a ring.

FIG. 4 shows in detail an example of truss bands organized according to an embodiment of the present invention. FIG. 4(A) is a side view illustrating the lift band 30, the truss bands 21*a* and 21*c*, the lift fixing band 31 and the base bands 24. FIG. 4(B) is a perspective view illustrating the lift band 30, the truss bands 21*a* to 21*d*, the lift fixing band 31, and the base bands 24 as seen from diagonally above.

In FIGS. 4(A) and 4 (B), the truss band 21*c* is folded at its upper end 42*c* and lower end 43*c*, and the upper end 42*c* is inserted in between the lift fixing band 31 and the lift band 30, and fixedly jointed using squeeze rivets, screws, adhesive, or other resin-based thread having a sufficient strength. On the other hand, the lower end 43*c* is fixedly jointed to one end of the base band 24 using the squeeze rivet 34, a screw, adhesive, or other resin-based thread having a sufficient strength. Here, the lower end of the lift band 30 is secured to the base bands 24 at the point of intersection of the vertical and horizontal base bands 24, i.e., at a lift band secured point 26. Of course, since the base bands 24 are secured to the bottom surface of the rectangular parallelepiped bag 1, securing to the base bands 24 means securing to the bottom surface of the rectangular parallelepiped bag 1. Alternatively, without using the lift fixing band 31, it is also acceptable to sew directly each truss band and the lift band 30 together. Such an embodiment will be explained below. Note that although one stage with only the truss band 21 is illustrated in FIG. 4, a plurality of stages of truss bands can also be provided as shown in FIG. 3(*b*).

FIG. 5 illustrates in detail another example of truss bands according to an embodiment of the present invention. FIG. 5(A) is a side view illustrating the lift band 30, the truss bands 21*a*, 21*ac*, and 21*c*, the lift fixing band 31, and the base bands 24. FIG. 5(B) is a perspective view illustrating the lift band 30, the truss bands 21*a* to 21*d*, 21*ac*, and 21*bd*, the lift fixing band 31, and the base bands 24.

In FIGS. 5(A) and 5 (B), the truss band 21 is formed as a single band that is made up of the truss band 21*a* on the diagonal portion, the truss band 21*c*, and the truss band 21*ac* that forms the hanging portion 29. That is, the truss band 21*ac* is a continuum of the truss band 21*a* and the truss band 21*c*. The truss band 21 shown in FIG. 5 is configured generally in the same manner as the truss band 21 shown in FIG. 4. However, the truss band 21 in FIG. 4 is terminated at the lift fixing band 31, whereas the truss band 21 in FIG. 5 is not terminated at the lift fixing band 31 but formed continuously via the truss band 21*ac* serving as the hanging portion 29. As described above, since the truss band 21 of FIG. 5 is partially different from the truss band 21 of FIG. 4 in structure, a description will be made only to the points different from those of FIG. 4.

In FIG. 5, the truss band 21*a* is secured by the upper end of the truss band 21*c* being folded and inserted in between the lift fixing band 31 and the lift band 30 to be fixedly jointed using squeeze rivets, screws, adhesive, or other resin-based thread having a sufficient strength. Furthermore, the upper ends of the truss band 21*a* and the truss band 21*c* inserted in between the lift fixing band 31 and the lift band 30 form the hanging portion 29 by the truss band 21*ac* that is continuous. Note that the continuum between the truss band 21*b* and the truss band 21*d* allows the truss band 21*bd* to form the hanging portion 29*bd*. However, for simplicity of the drawing, the hanging portion 29*bd* is omitted. The truss band 21*ac* inserted in between the lift fixing band 31 and the lift band 30 is fixedly jointed at the lift fixing band 31 using squeeze rivets, screws, adhesive, or other resin-based thread having a sufficient strength. Furthermore, without using the lift fixing band 31, it is also acceptable to sew directly each truss band and the lift band 30 together. Such a configuration allows the truss band 21*a*, the truss band 21*c*, and the truss band 21*ac* to be formed as a single band. In this case, the hanging portion is made up of two portions, i.e., the hanging portion 29*ac* and the hanging portion 29*bd*, thereby providing improved safety to hanging operations. Note that although one stage with only the truss band 21 is illustrated in FIG. 5, a plurality of stages of truss bands can also be provided as shown in FIG. 3(*b*).

FIG. 6 illustrates in detail another example of truss bands according to an embodiment of the present invention. FIG. 6(A) is a side view illustrating the lift band 30, the truss band 21, a hook 36, hoisting rings 37 and 38, the upper hoisting ring securing portion 39, the lower hoisting ring securing portion 40, and the base bands 24. FIG. 6(B) is a perspective view illustrating the lift band 30, the truss band 21, the hook 36, the upper hoisting ring 37, the lower hoisting ring 38, the upper hoisting ring securing portion 39, the lower hoisting ring securing portion 40, and the base bands 24.

In FIGS. 6(A) and 6(B), the truss band 21*c* is provided at its upper and lower ends with the hook 36*c*. The hook portion 36*c* of the upper end of the truss band 21*c* is retained with the upper hoisting ring 37*c*, the upper hoisting ring 37*c* is retained at the upper hoisting ring securing portion 39*c*, and the upper hoisting ring securing portion 39*c* is secured to the lift band 30. Furthermore, the hook 36*c* of the lower end of the truss band 21*c* is retained with the lower hoisting ring 38*c*, the lower hoisting ring 38*c* is retained at the lower hoisting ring securing portion 40*c*, and the lower hoisting ring securing portion 40*c* is secured to the base band 24. The upper hoisting ring securing portion 39*c* and the lower hoisting ring securing portion 40*c* are fixedly jointed to the lift band 30 and the base band 24, respectively, using a squeeze rivet 34, a screw, adhesive, or other resin-based thread having a sufficient strength. Since a description was made to the truss band 21*c* above, and the other truss bands 21*a*, 21*b*, and 21*d* have the same configuration as the truss band 21*c*, they will not be repeatedly described. According to this type of configuration, the truss band 21 is assembled in a manner such that the upper and lower hoisting rings 37 and 38 are secured in advance to the upper hoisting ring securing portion 39 and the lower hoisting ring securing portion 40, respectively. Then, afterwards, the upper and lower end hooks 36 can be attached to the upper and lower hoisting rings 37 and 38, respectively. Accordingly, the work for attaching the truss band 21 is facilitated. Note that although one stage with only the truss band 21 is illustrated in FIG. 6, a plurality of stages of truss bands can also be provided as shown in FIG. 3(*b*).

FIG. 7 illustrates in detail still another example of truss bands according to an embodiment of the present invention. FIG. 7(A) is a side view illustrating the truss bands 21 and 22, the hook 36, the lower hoisting ring 38, the lower hoisting ring securing portion 40, and the base bands 24. FIG. 7(B) is a perspective view illustrating the truss bands 21 and 22, the hook 36, the lower hoisting ring 38, the lower hoisting ring securing portion 40, and the base bands 24.

In FIGS. 7(A) and 7 (B), the truss bands 21*a* and 22*a* configured as two stages are provided at their lower ends with the hook 36*a*, respectively, while the truss bands 21*c* and 22*c* are provided at their lower ends with the hook 36*c*, respectively. The upper ends of the truss bands 21*a*, 21*c*, 22*a*, and 22*c* are retained at the lift band securing portion 44. Here, the truss bands 21*a* and 21*c* and the truss bands 22*a* and 22*c* are each formed of a single band, string, rope or the like (hereinafter referred to as band), and each folded at an upside to form the hanging portion 29. All the truss bands 21*a*, 21*c*, 22*a*, and 22*c* are fixed using a ring or string at the lift band securing portion 44. The truss bands 21*a*, 21*c*, 22*a*, and 22*c* may also be tied and thereby secured at the lift band securing portion 44. The hooks 36*a* and 36*c* at the lower ends of the truss bands 21*a* and 21*c* are retained at the lower hoisting rings 38*a* and 38*c*, respectively. The lower hoisting rings 38*a* and 38*c* are retained at the lower hoisting ring securing portions 40*a* and 40*c*, respectively, while the lower hoisting ring securing portions 40*a* and 40*c* are secured to the base bands 24, respectively. Since the truss bands 21*a* and 21*c* and the truss bands 22*a* and 22*c* were explained above, and the other truss bands 21*b* and 21*d*, and 22*b* and 22*d* have the same configuration, they will not be repeatedly described. According to this type of configuration, the truss bands 21 and 22 are assembled in a manner such that each lower hoisting ring 38 is secured in advance to the lower hoisting ring securing portion 40. Then, afterwards, the ends of the truss bands 21 and 22 can be attached to the lower hoisting rings 38, respectively. Accordingly, the work for attaching the truss band 21 is facilitated. Note that the end of the truss bands 21 and 22 is provided with the hook 36 as described above. However, without providing the hook 36, the end of the truss bands 21 and 22 can be directly tied to the lower hoisting ring 38 to connect between the truss bands 21 and 22 and the lower hoisting ring 38. Note that although the case of two stages with the truss band 21 and the truss band 22 was illustrated in FIG. 7, a plurality of stages of truss bands can also be provided as shown in FIG. 3(*b*).

FIGS. 8 and 9 are explanatory perspective views illustrating how to use the shape-retention-type hoisting rectangular parallelepiped bag 1 according to an embodiment of the present invention. As shown in FIG. 8(A), to use the shape-retention-type hoisting rectangular parallelepiped bag 1 according to an embodiment of the present invention, the bag is filled with soil 25 from above while the right and left cover portions 13*a* and 13*b* and the forward and backward cover portions 14*a* and 14*b* are kept open.

After the rectangular parallelepiped bag 11 has been filled with a sufficient amount of soil 25, the hanging portion 29 is drawn out of the soil 25. Next, as shown in FIG. 8(B), the right and left cover portions 13*a* and 13*b* are closed, and the cover portions 13*a* and 13*b* are locked using the belts 15 and the lock members 16. Then, the forward and backward cover portions 14*a* and 14*b* are closed, and the hanging portion 29 is drawn out of the opening formed of the groove 17 at the center of the upper surface of the rectangular parallelepiped bag 11. Then, the cover portions 14*a* and 14*b* are locked using the belts 15 and the lock members 16. However, the cover portions 13*a* and 13*b* being locked with the belts 15 and the lock members 16 are concealed by the cover portions 14*a* and 14*b* and thus cannot be seen in FIG. 8(B).

As described above, the rectangular parallelepiped bag 11 is filled with a sufficient amount of soil 25, and then with the right and left cover portions 13*a* and 13*b*, and the forward and backward cover portions 14*a* and 14*b* being closed, the hanging portion 29 is drawn out of the opening formed by the groove 17. Thereafter, as shown in FIG. 9(A), the hanging portion 29 is engaged at its end with a hook 28 by a crane truck (not shown) thereby causing the hanging portion 29 to lift the rectangular parallelepiped bag 11. Thus, the shape-retention-type hoisting rectangular parallelepiped bag 1 is carried to a predetermined position so that a plurality of rectangular parallelepiped bags 1 are stacked in layers as shown in FIG. 9(B). FIG. 9(B) shows an example of stacking the bags in layers. Typically, the bags in the odd layers, i.e., the first and third layers are piled in the same manner in the vertical direction, while the bags in the even layer or the second layer are piled up to be dislocated by half the width of the rectangular parallelepiped bag relative to those in the odd layers. FIG. 9 shows an example of stacking the rectangular parallelepiped bags in layers. However, the bags can also be stacked in the vertical direction not only in three layers but also in any number of layers, as required, without being limited to the three layers as illustrated. Likewise, in the horizontal direction, the bags can also be piled up not only in one row as illustrated but also in any number of rows.

As described above, in the shape-retention-type hoisting rectangular parallelepiped bag 1 according to the embodiment of the present invention, one end of the lift band 30 is secured to the lift band secured point 26 of the base bands 24 in the rectangular parallelepiped bag 11. One end of each of the truss bands 21 is then secured to the lift band 30 and the other end of each of the truss bands 21 is secured to a point on the base band 24 to support the rectangular parallelepiped bag 11. Accordingly, raising the shape-retention-type hoisting rectangular parallelepiped bag 1 with the hanging portion 29 causes the soil 25 around the lift band 30 and the truss band 21 inside the rectangular parallelepiped bag 11 to be compressed. This allows the rectangular parallelepiped bag 11 to maintain its rectangular parallelepiped shape even while being kept lifted in the air, thus making the shape-retention-type hoisting rectangular parallelepiped bag 1 stable in shape. This will be discussed in more detail below.

Suppose that the structure of the shape-retention-type hoisting rectangular parallelepiped bag 1 according to an embodiment of the present invention is viewed from the arrow A of FIG. 1. In this case, as shown in FIG. 10(A), the truss band 21*a*, the lift band 30, and the bottom surface 12 define a structure or a triangle T1. Likewise, the truss band 21*c*, the lift band 30, and the bottom surface 12 define a structure or a triangle T2. The truss band 22*a*, the lift band 30, and the bottom surface 12 define a structure or a triangle T3. The truss band 22*c*, the lift band 30, and the bottom surface 12 define a structure or a triangle T4.

Here, when lifting the rectangular parallelepiped bag 11 with the hanging portion 29, the hanging portion 29 is subjected to force F0 due to the self-weight of the bag 11, thereby causing a tensile force F2 to be applied to the truss bands 21*a* and 21*c*. The truss bands 21*a* and 21*c* forms an angle θ1 relative to the bottom surface 12. Thus, the tensile force F2 on the truss bands 21*a* and 21*c* is resolved into force F3 for raising the rectangular parallelepiped bag 11 upwardly and force F4 for pulling it inwardly at the points 18*a*1 and 18*c*1 where the truss bands 21*a* and 21*c* hang the bottom surface 12. The force F3 produced to raise the rectangular parallelepiped bag 11 upwardly causes the points 18*a*1 and 18*c*1 where the truss bands 21*a* and 21*c* lift the bottom surface 12 to be raised. This causes the soil 25 filled in the rectangular parallelepiped bag 11 to be pushed upwardly, thus compressed, and packed down. Furthermore, the inwardly pulling force F4 causes the soil 25 around the points 18*a*1 and 18*c*1 to be compressed laterally and packed down.

The same holds true for the truss bands 22*a* and 22*c*. That is, when lifting the rectangular parallelepiped bag 11 with the hanging portion 29, the hanging portion 29 is subjected to force F0 due to the self-weight of the bag 11, thereby causing a tensile force F5 to be applied to the truss bands 22*a* and 22*c*. The truss bands 22*a* and 22*c* forms an angle θ2 relative to the bottom surface 12. Thus, the tensile force F5 on the truss bands 22*a* and 22*c* is resolved into force F6 for raising the rectangular parallelepiped bag 11 upwardly and force F7 for pulling it inwardly at the points 19*a*1 and 19*d* where the truss bands 22*a* and 22*c* hang the bottom surface 12. The force F6 produced to raise the rectangular parallelepiped bag 11 upwardly causes the points 19*a*1 and 19*c*1 where the truss bands 22*a* and 22*c* lift the bottom surface 12 to be raised. This causes the soil 25 around the points 19*a*1 and 19*c*1 to be pushed upwardly, thus compressed, and packed down. Furthermore, the inwardly pulling force F7 causes the soil 25 around the points 19*a*1 and 19*c*1 to be compressed laterally and packed down.

Furthermore, since the end of the lift band 30 is secured to the lift band secured point 26 on the bottom surface 12 of the rectangular parallelepiped bag 11, the lift band secured point 26 of the bottom surface 12 is subjected to force F1 for raising the rectangular parallelepiped bag 11 upwardly. Accordingly, the center of the bottom surface 12 is raised upwardly, causing the soil filled in the rectangular parallelepiped bag 11 to be compressed and packed down. That is, as shown in FIG. 10(B), raising the rectangular parallelepiped bag 11 with the lift band 30 causes the rectangular parallelepiped bag 11 to be lifted at the points 18*a*1 and 18*c*1, and the points 19*a*1 and 19*c*1 where the truss bands are lifting the bottom surface 12. This causes the soil 25 around the points 18*a*1 and 18*c*1, and the points 19*a*1 and 19*c*1 to be upwardly and laterally compressed and packed down. As shown in FIG. 10(B), since a plurality of truss bands are used to extend the range of compression gradually in stages, it is possible to reduce a recessed portion which appears at the center of the bottom having the lift band attached thereto and occurs when the bag is kept lifted. This allows no gap to be produced at the bottom of the sand bag when it is placed down in position. That is, when having been installed, the bag has almost no deformation, thereby making the control of the size easy.

FIG. 10(B) is a view illustrating with exaggeration the points 18*a*1 and 18*c*1, and the points 19*a*1 and 19*c*1 being pulled upwardly. In practice, this shape may be different from the one shown in this figure because it would be changed depending on the position of the points 18*a*1 and 18*c*1, the points 19*a*1 and 19*c*1, and the tensile force on the truss band 21. In FIG. 10(B), the soil in the hatched portion is compressed and packed down, and thus the rectangular parallelepiped bag 1 can maintain its shape with stability.

Note that in the first embodiment of the present invention, lifting the rectangular parallelepiped bag 11 using the lift band 30 causes a recessed portion 35 to appear at the central portion 19 of the bottom surface 12. When being produced, the recessed portion 35 of the bottom surface 12 precisely reflects the position of the central portion 19 of the rectangular parallelepiped bag 11. Thus, using the recessed portion 35 for positioning makes it possible to lay down a plurality of shape-retention-type hoisting rectangular parallelepiped bags with accuracy.

The present invention is not limited to the aforementioned embodiments but may be subjected to various modifications and applications without departing from the scope of the invention.

INDUSTRIAL APPLICABILITY

The bag of the present invention can be used as a sand bag for irrigation works or river-improvement works, slope face reinforcement or retaining wall construction, accretion for roads or buildings, reclamation works, or natural disaster restoration works. The sand bag is also applicable in combination with a sandbag involved construction method that employs small sand bags. The inventive bag allows execution of works to cover a large area at one time, thereby providing improved work efficiency. Another aspect of the inventive bag or its rectangular shape can also be utilized to carry grain-shaped substances such as wheat or soybeans in the bag, allowing for loading goods or placing stocks with improved efficiency.

DESCRIPTION OF REFERENCE NUMERALS

Figure 1:
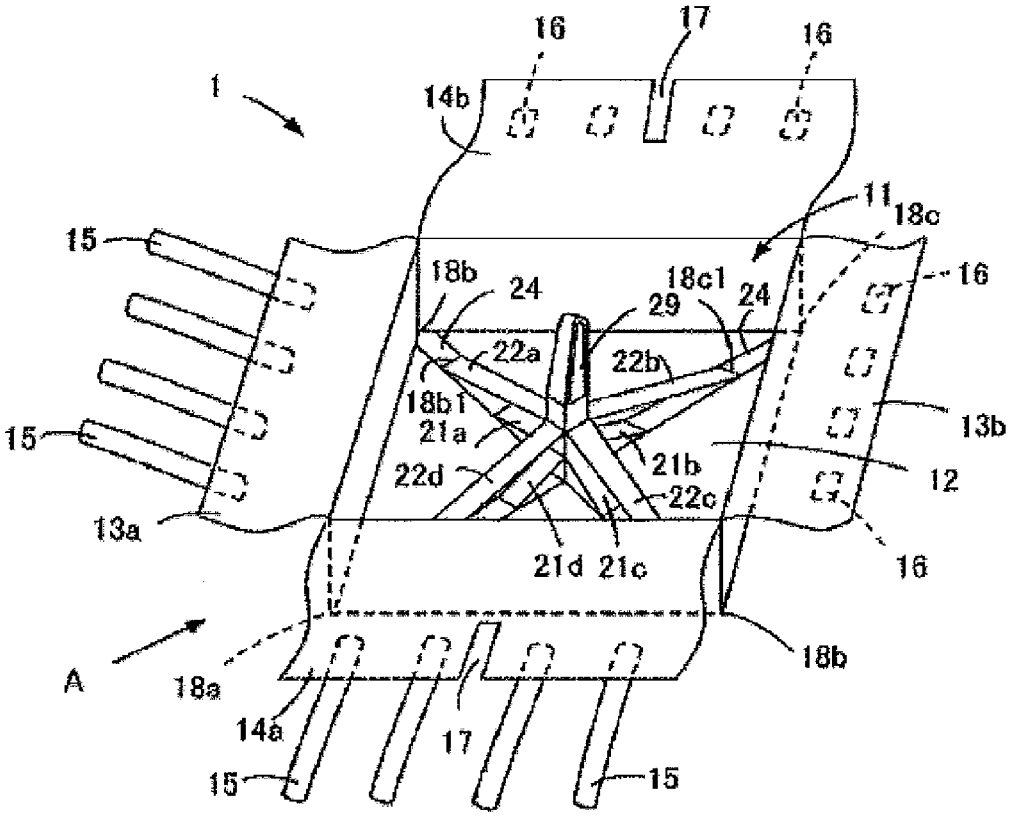
FIG. 1 is a perspective view illustrating a shape-retention-type hoisting rectangular parallelepiped bag according to an embodiment of the present invention.
Figure 2:
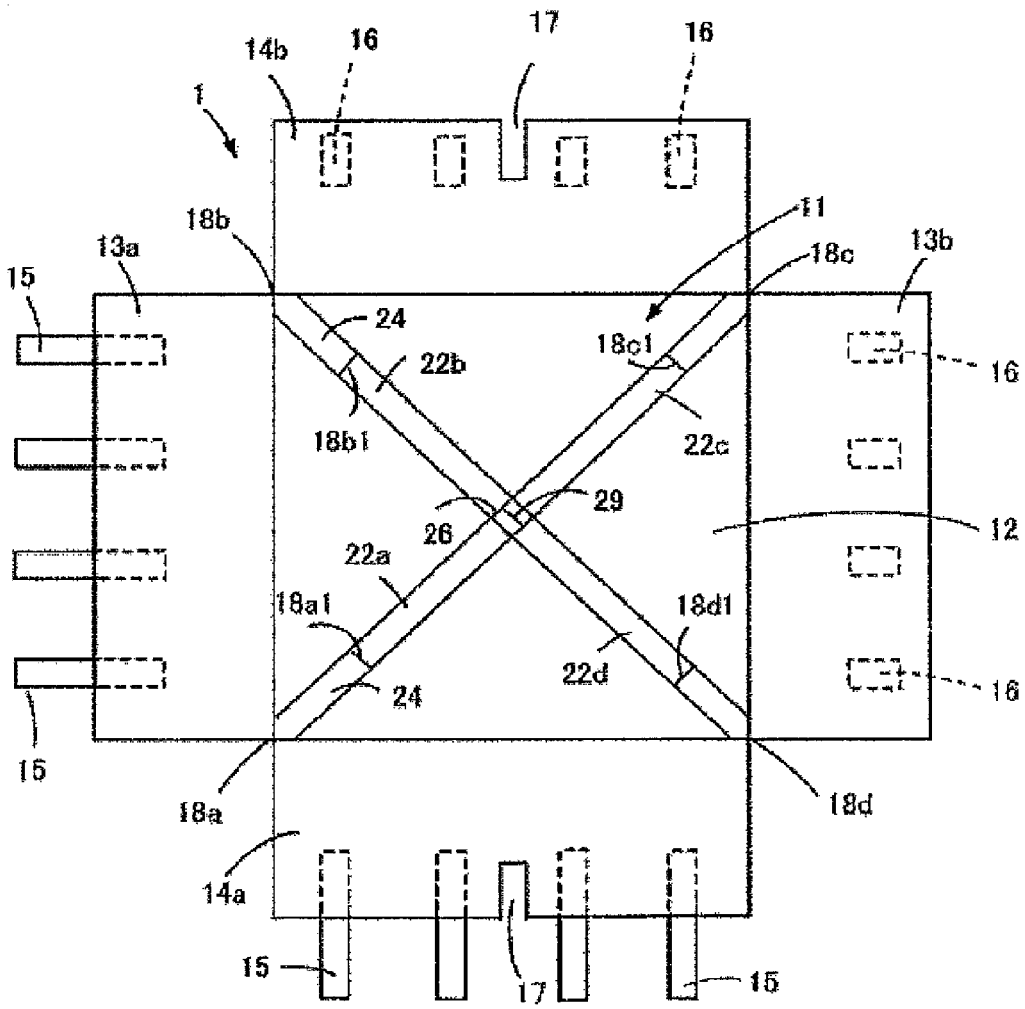
FIG. 2 is a plan view illustrating a shape-retention-type hoisting rectangular parallelepiped bag according to an embodiment of the present invention.
Figure 3:
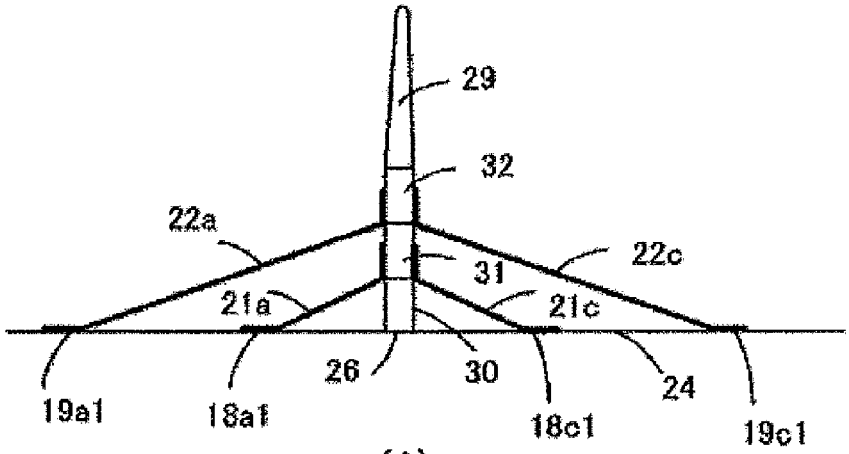
FIG. 3 shows truss bands organized according to an embodiment of the present invention.
Figure 3:
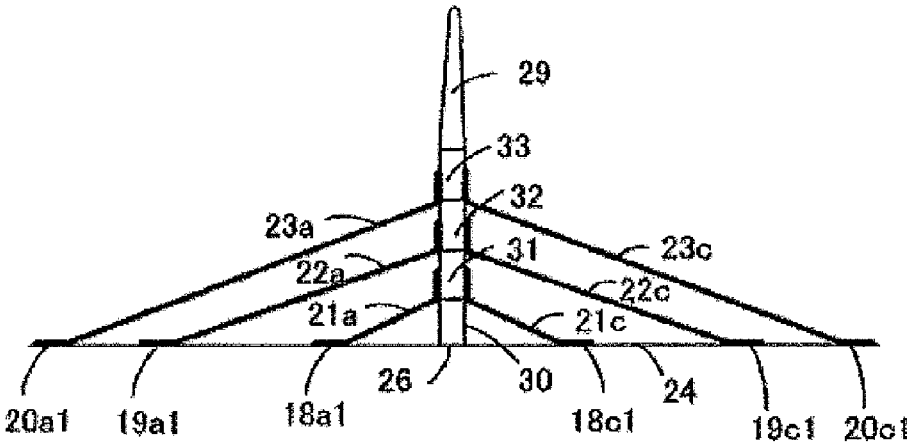
Figure 4:
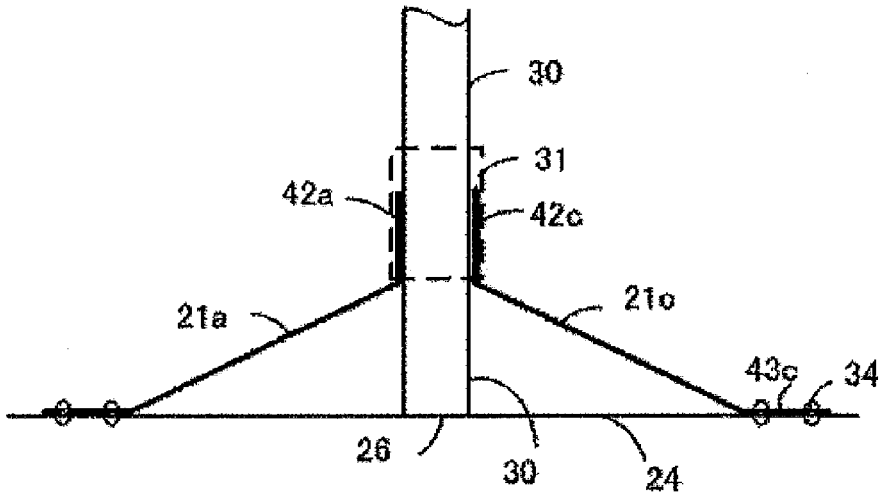
FIG. 4 shows in detail an example of truss bands organized according to an embodiment of the present invention.
Figure 4:
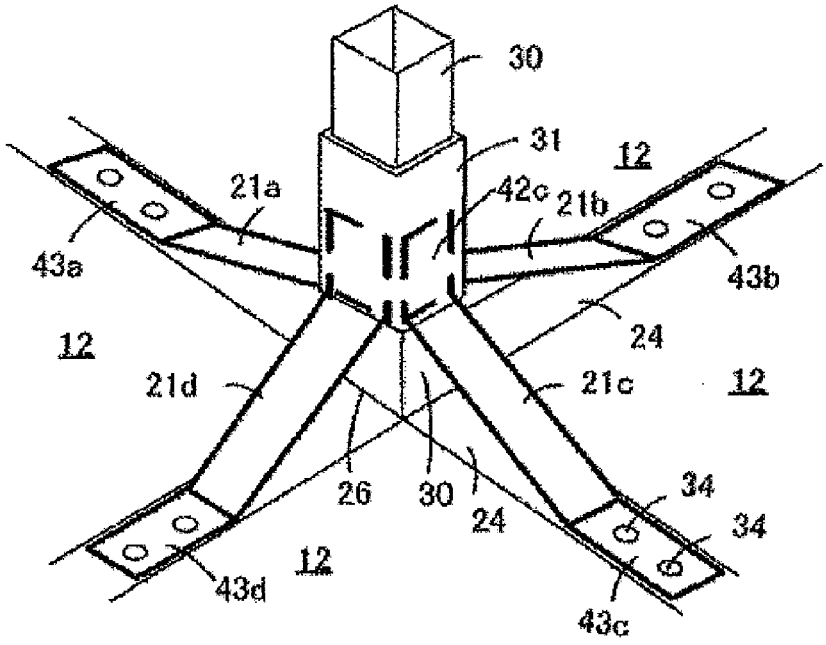
Figure 5:
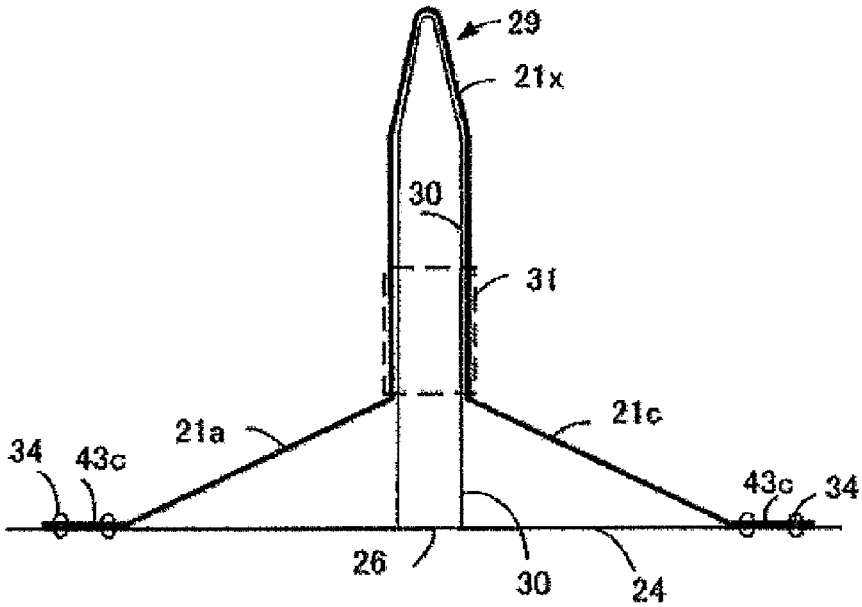
FIG. 5 shows in detail another example of truss bands organized according to an embodiment of the present invention.
Figure 5:
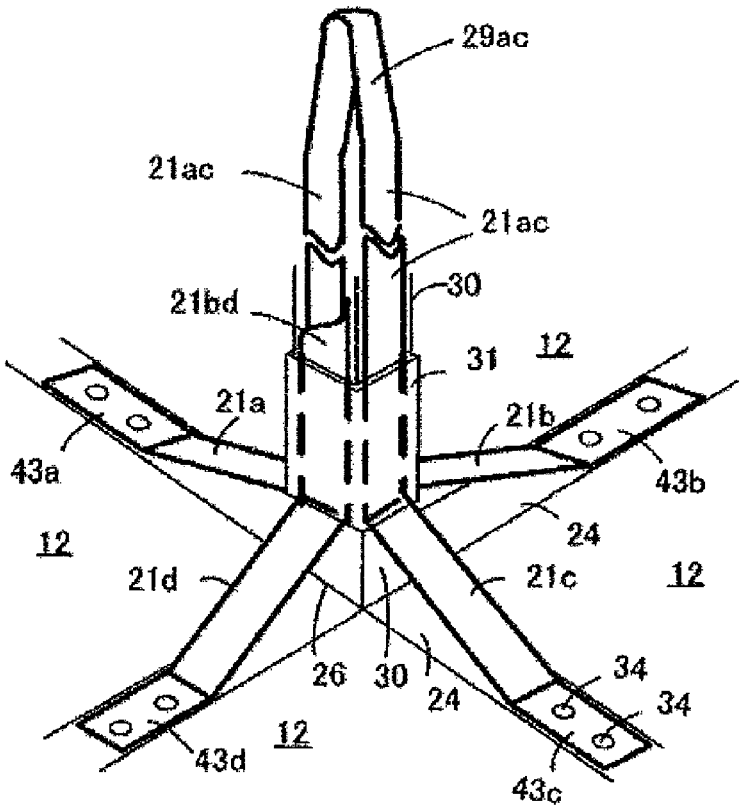
Figure 6:
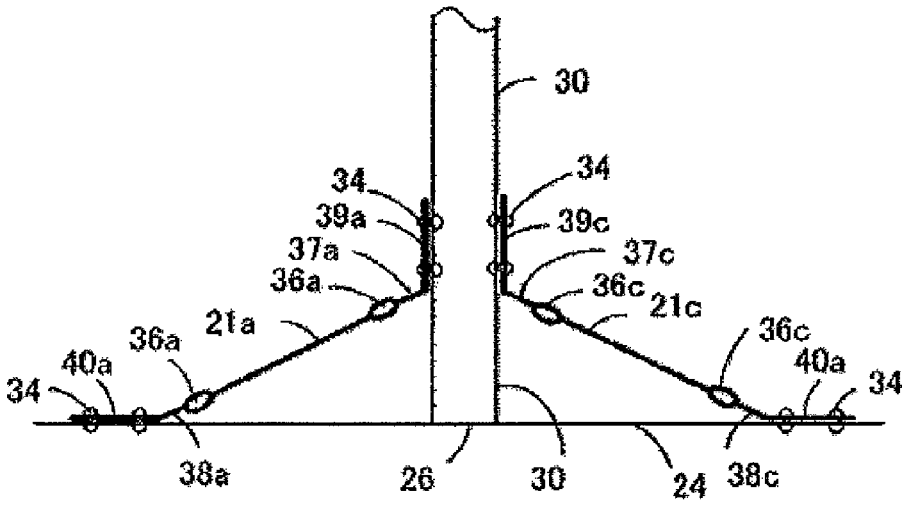
FIG. 6 shows in detail still another example of truss bands organized according to an embodiment of the present invention.
Figure 6:
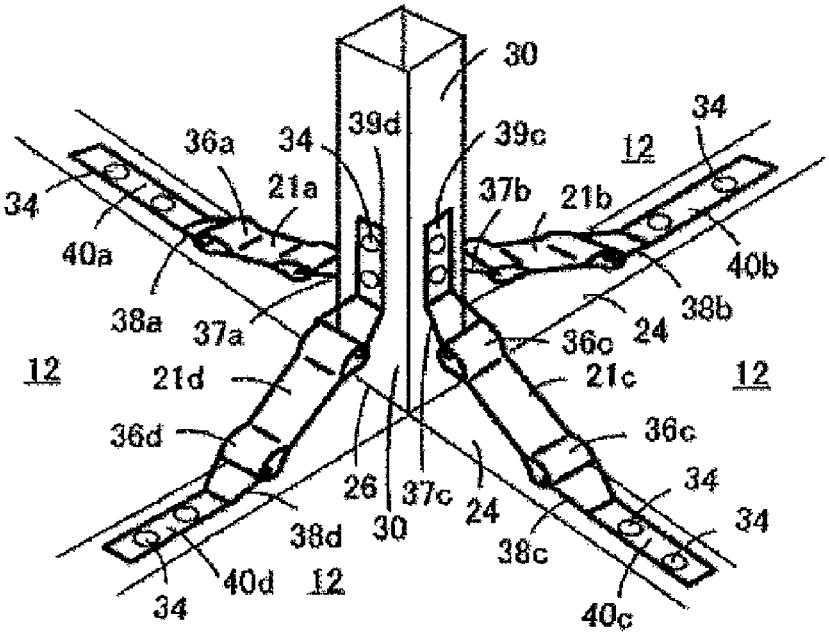
Figure 7:
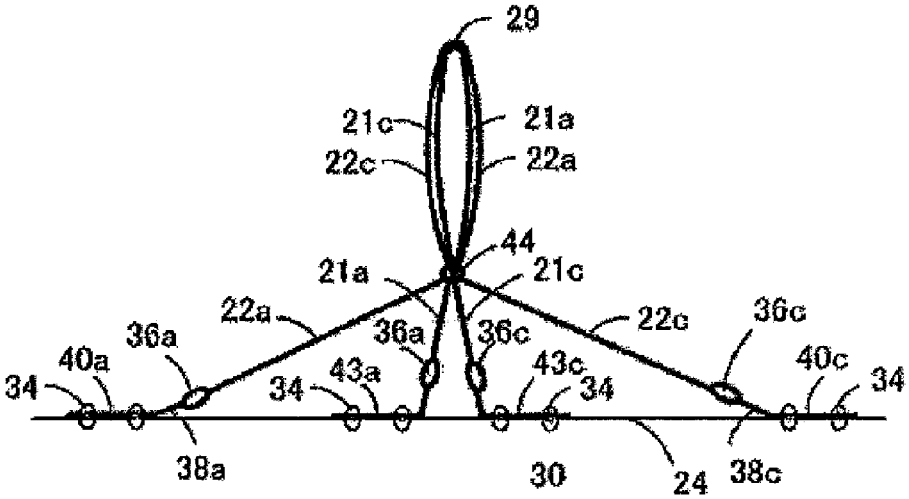
FIG. 7 shows in detail still another example of truss bands organized according to an embodiment of the present invention.
Figure 7:
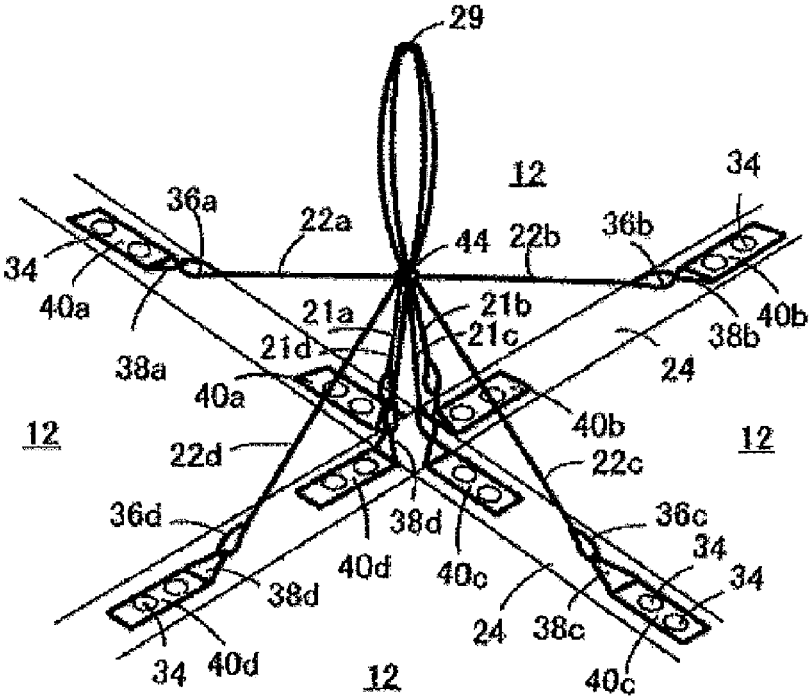
Figure 8:
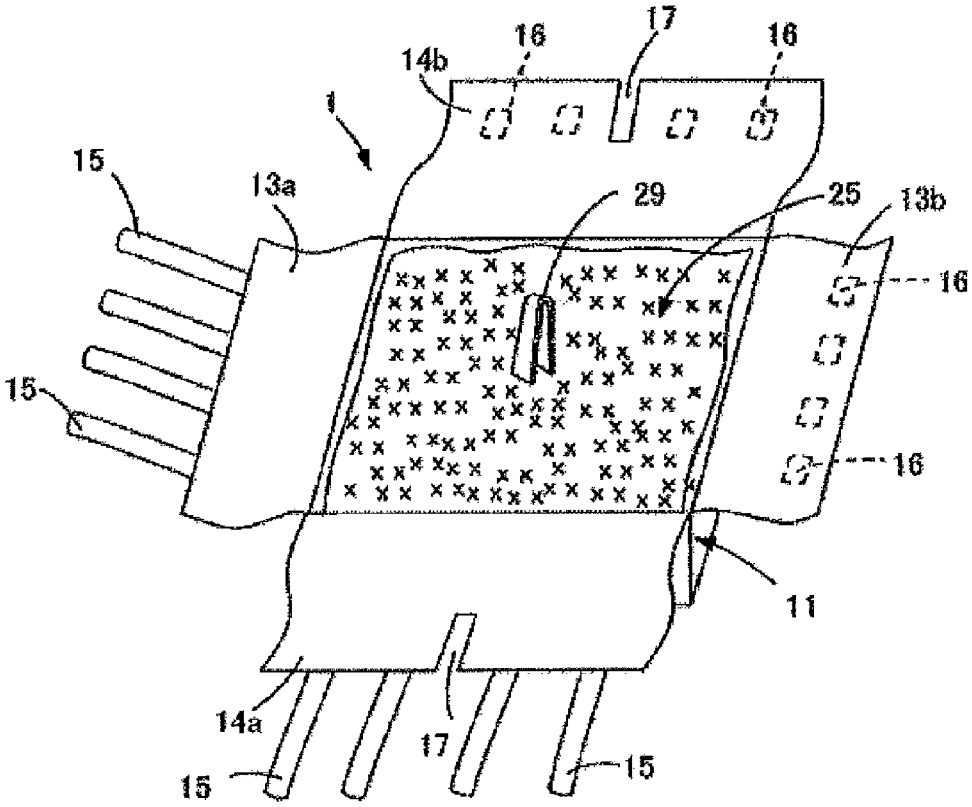
FIG. 8 shows explanatory perspective views illustrating how to use a shape-retention-type hoisting rectangular parallelepiped bag according to an embodiment of the present invention.
Figure 8:
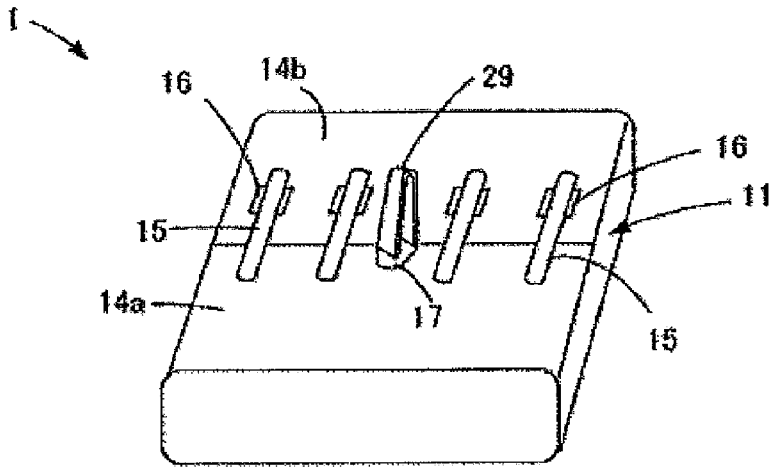
Figure 9:
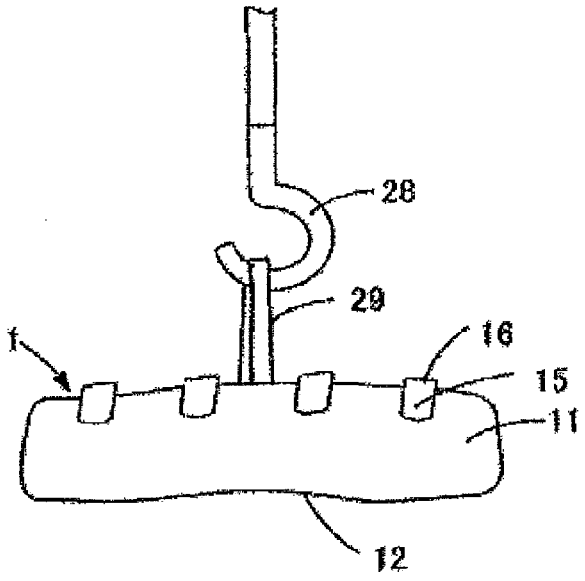
FIG. 9 shows explanatory views illustrating how to use a shape-retention-type hoisting rectangular parallelepiped bag according to an embodiment of the present invention.
Figure 9:
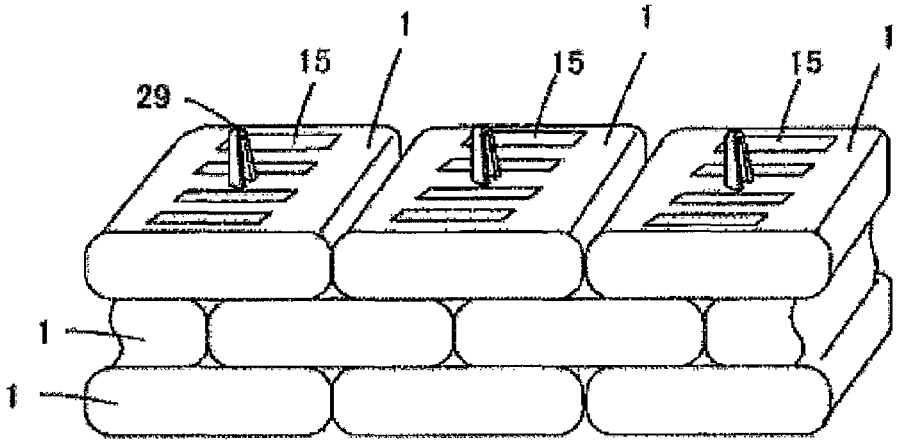
Figure 10:
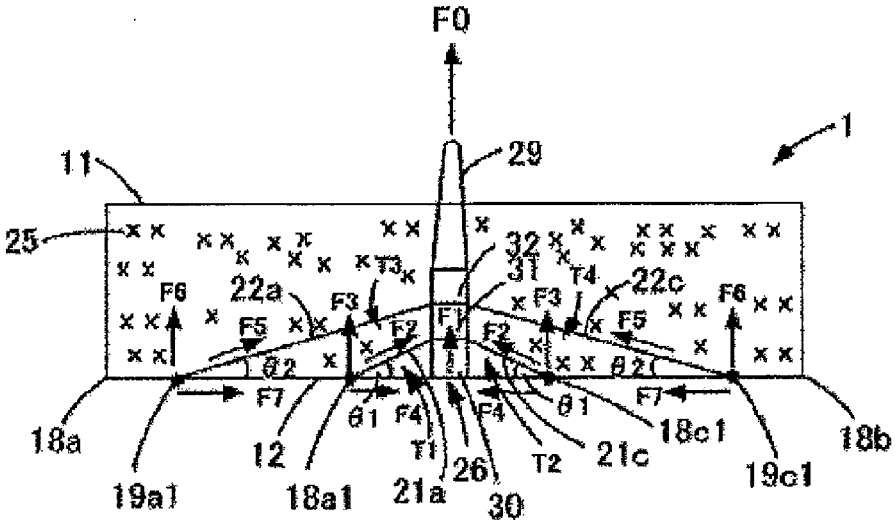
FIG. 10 shows explanatory views illustrating the principle of a shape-retention-type hoisting rectangular parallelepiped bag according to an embodiment of the present invention.
Figure 10:
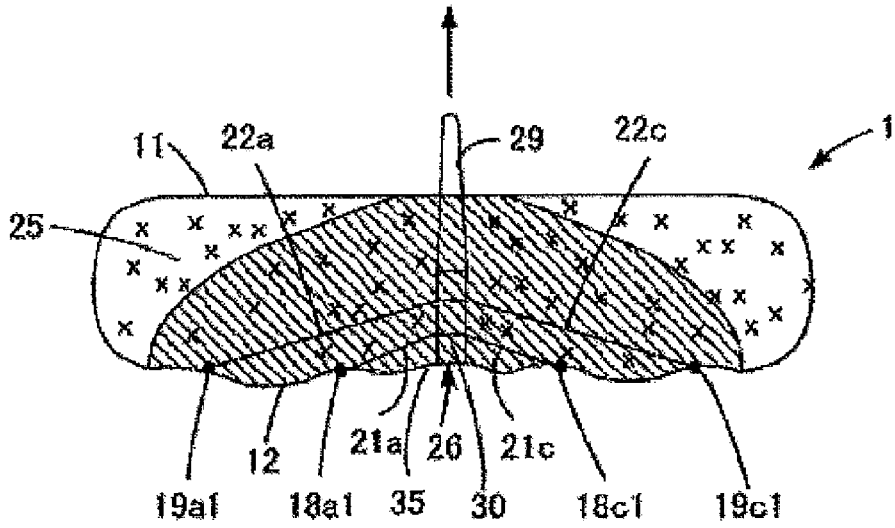
Figure 11:
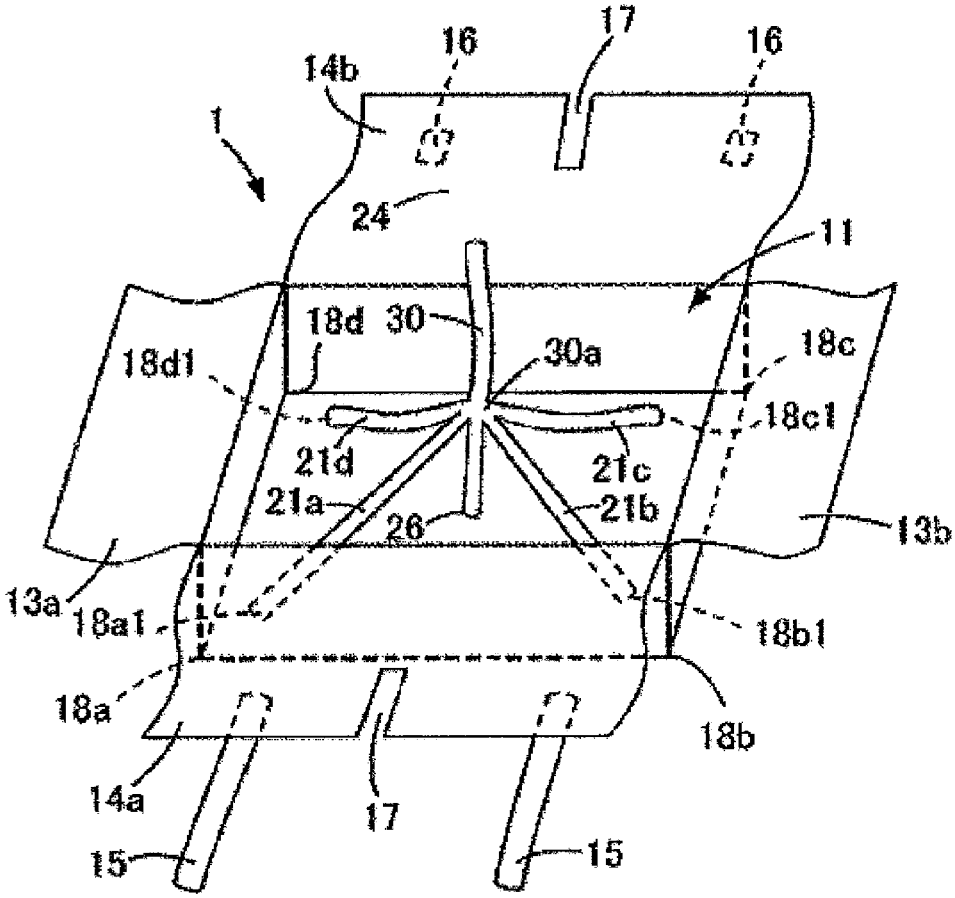
Fig. 11 (PRIOR ART)
FIG. 11 is a perspective view illustrating a conventional shape-retention-type hoisting rectangular parallelepiped bag.
Figure 12:
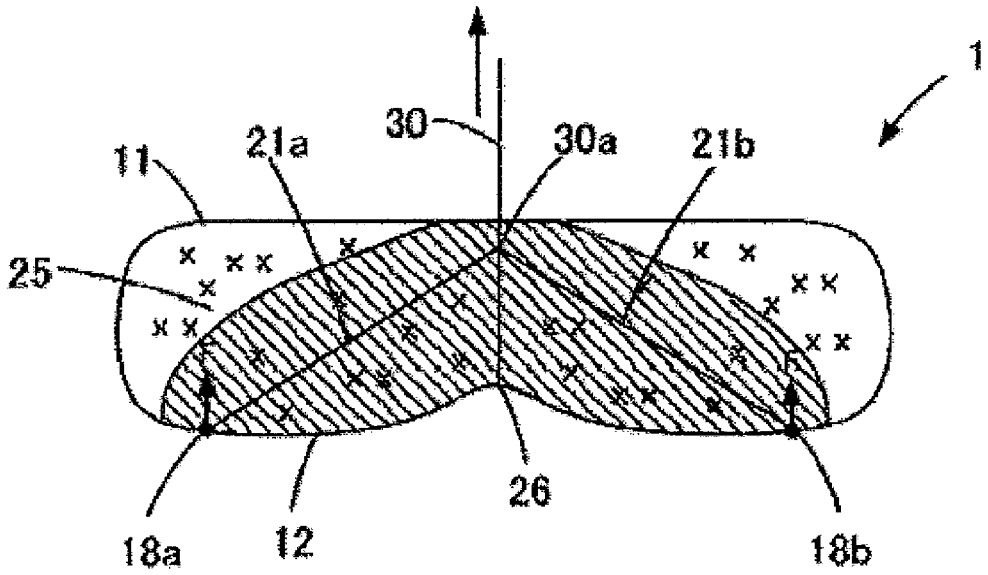
Fig. 12 (PRIOR ART)
FIG. 12 is an explanatory view illustrating the principle of a conventional shape-retention-type hoisting rectangular parallelepiped bag.
Figure 13:
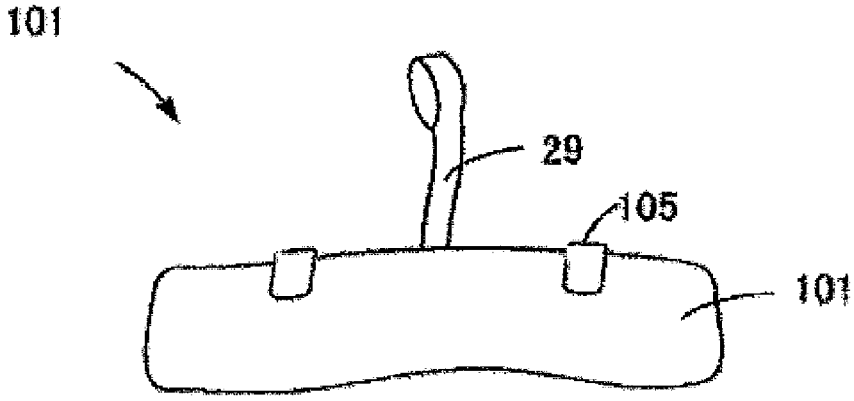
Fig. 13 (PRIOR ART)
FIG. 13 is an explanatory view illustrating how to use a conventional shape-retention-type hoisting rectangular parallelepiped bag.
Figure 14:
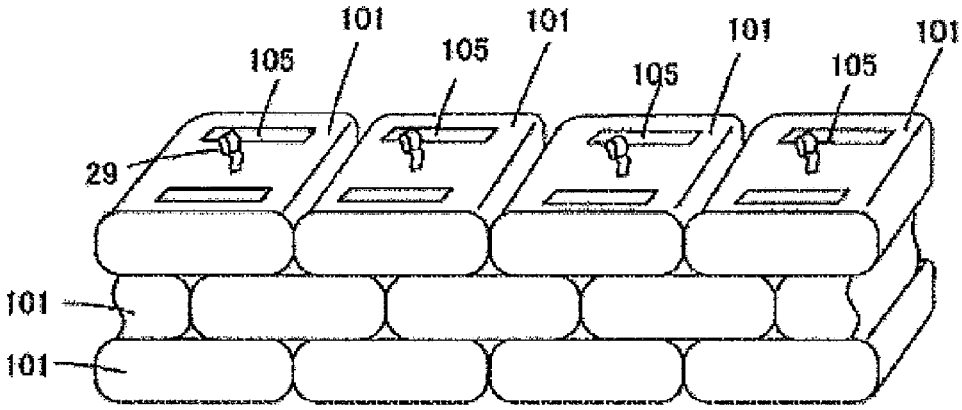
Fig. 14 (PRIOR ART)
FIG. 14 is an explanatory view illustrating conventional shape-retention-type hoisting rectangular parallelepiped bags stacked in layers.

1 Shape-retention-type hoisting rectangular parallelepiped bag
11 Rectangular parallelepiped bag
12 Bottom surface
13*a*, 13*b*, 14*a*, 14*b* Cover portion
15 Belt
16 Lock member
17 Groove
18*a*1 to 18*d*1 Truss band secured point
19*a*1, 19*c*1 Truss band secured point
20*a*1, 20*c*1 Truss band secured point
21*a* to 21*d* Truss band
22*a* to 22*d* Truss band
23*a* to 23*d* Truss band
24 Base band
25 Soil
26 Lift band secured point
27 Ring
28 Hook
29 Hanging portion
30 Lift band
30*a* Lift band fixing point
31 Lift fixing band
32 Lift fixing band
33 Lift fixing band
34 Squeeze rivet
35 Recessed portion
36 Hook
37 Upper hoisting ring
38 Lower hoisting ring
39 Upper hoisting ring securing portion
40 Lower hoisting ring securing portion
42 Upper end of truss band
43 Lower end of truss band
44 Lift band securing portion

The invention claimed is:

1. A shape-retention hoisting bag, comprising:

a rectangular parallelepiped bag and adapted to be filled with soil;

base bands provided along diagonal lines of the rectangular parallelepiped bag;

a quadrangular-prism-shaped lift band having one end connected to a point of intersection of the base bands and the other end connected to a hanging portion;

a plurality of quadrangular-prism-frame fixing bands surrounding the quadrangular-prism-shaped lift band; and a plurality of truss bands, each of the truss bands having one end secured to each of the fixing bands on each surface of the lift band between the lift band and the fixing band, each one of the truss bands having the other end secured to the base band at a point spaced apart by a given distance from a center of the lift band.

2. The shape-retention hoisting bag according to claim 1, wherein the point spaced apart by the given distance from the center is set so that one end of a lift band having the other end secured to an upper fixing band of the plurality of fixing bands is located at a distance farther from the center than one end of a lift band having the other end secured to a lower fixing band.

3. The shape-retention hoisting bag according to claim 1, wherein the end of the hanging portion is formed in an arch shape to be hooked.

4. A shape-retention hoisting bag, comprising:

a rectangular parallelepiped bag and adapted to be filled with soil;

base bands provided along diagonal lines of the rectangular parallelepiped bag;

a quadrangular-prism-shaped lift band having one end connected to a point of intersection of the base bands and the other end connected to a hanging portion;

a plurality of upper hoisting ring securing portions fixed at different heights on each surface of the quadrangular-prism-shaped lift band;

a plurality of lower hoisting ring securing portions located on the base band at predetermined different distances from the center of the lift band; and a plurality of truss bands, each one of the truss bands having one end secured via a hook to each of the upper hoisting ring securing portions on each surface of the lift band, each one of the truss bands having the other end secured via a hook to each of the lower hoisting ring securing portions.

5. A shape-retention hoisting bag, comprising:

a rectangular parallelepiped bag and adapted to be filled with soil;

base bands provided along diagonal lines of the rectangular parallelepiped bag;

a plurality of lower hoisting ring securing portions located opposite to points on the base band at predetermined different distances from the center of the aforementioned rectangular parallelepiped bag; and a plurality of truss bands, each of the truss bands having one end secured to a lower hoisting ring provided at one side of the opposing lower hoisting ring securing portion, each of the truss bands having the other end secured to a lower hoisting ring provided at the other side, the truss band being secured at a lift band securing portion provided in position, the truss band being folded over at a midpoint thereof to form a hanging portion.

* * * * *